United States Patent [19]

Fukuda et al.

[11] Patent Number: 5,025,650

[45] Date of Patent: Jun. 25, 1991

[54] APPARATUS FOR FORMING PLATES OF IRREGULAR CROSS-SECTIONAL SHAPE

[75] Inventors: Hiroshi Fukuda; Hideki Azuma, both of Matsumoto, Japan

[73] Assignee: Kabushiki Kaisha Kawai Gakki Seisakusho, Japan

[21] Appl. No.: 379,724

[22] Filed: Jul. 14, 1989

Related U.S. Application Data

[63] Continuation of Ser. No. 41,826, Apr. 23, 1987, abandoned.

[30] Foreign Application Priority Data

Apr. 23, 1986 [JP] Japan ..... 61-60179

[51] Int. Cl.[5] ..... B21D 7/02

[52] U.S. Cl. ..... 72/220; 72/214

[58] Field of Search ..... 72/220, 207, 214, 210, 72/211, 192, 376

[56] References Cited

U.S. PATENT DOCUMENTS

| | | | |
|---|---|---|---|
| 66,905 | 7/1867 | Stillman | 72/220 |
| 435,494 | 9/1890 | Goehler | 72/220 |
| 727,629 | 5/1903 | Hill | 72/220 |
| 3,392,566 | 7/1968 | Sporck | 72/220 |
| 3,635,065 | 1/1972 | Senzimir | 72/214 |
| 3,792,602 | 2/1974 | Fukuda | 72/220 |
| 4,528,836 | 7/1985 | Durand-Text | 72/376 |

FOREIGN PATENT DOCUMENTS

| | | | |
|---|---|---|---|
| 52-153866 | 12/1977 | Japan . | |
| 0406582 | 11/1973 | U.S.S.R. | 72/214 |

*Primary Examiner*—W. Donald Bray
*Attorney, Agent, or Firm*—Michael N. Meller

[57] ABSTRACT

An improved apparatus for forming plates of irregular cross-sectional shape has a plate-form die which cooperates with a plurality of reciprocating rollers for forming a strip of plate material which is passed incrementally between the rollers and the die. The die includes a plate surface portion having a wedge-shaped leading end portion for forming a groove in the plate material. The rollers reciprocate with a stroke which is less than the length of the plate surface portion.

3 Claims, 1 Drawing Sheet

APPARATUS FOR FORMING PLATES OF IRREGULAR CROSS-SECTIONAL SHAPE

This application is a continuation of Application Ser. No. 41,826, filed 4/23/83 now abandoned.

FIELD OF THE INVENTION

This invention relates to an apparatus for forming plates of irregular cross-sectional shape which have a small-thickness portion and a large-thickness portion, the plates being formed out of a relatively thick plate material. The invention relates more particularly to an apparatus for forming parts such as contact members for connectors, contact members for relays, terminal members for wrapping connections, reeds for musical instruments and the like.

BACKGROUND OF THE INVENTION

One of the inventors has already proposed an apparatus of the aforementioned kind wherein a long strip of band of plate material is fed longitudinally between a plate-form die and a roller, as disclosed in U.S. Pat. No. 3,792,602. The long strip or band of plate material has a relatively high elasticity. For example, copper alloy, stainless steel or nickel silver may be used. The plate material is brought into contact with a plate surface portion of the plate-form die, the plate surface portion being sharpened at a leading end portion. A pressure roller means is arranged so that a single roller is rolled with a reciprocating stroke corresponding to the plate surface portion of the plate-form die for pressing the long strip or band of plate material against the plate surface portion. Thus, this type of apparatus is advantageous in that the plate of irregular sectional shape can be manufactured without the waste of material which attends forming by cutting.

However, since the pressure roller means of the foregoing prior art apparatus comprises a single pressure roller, and the single pressure roller has a reciprocating stroke corresponding to the plate surface portion of the plate-form die for pressing the long strip or band of plate material, the prior art apparatus is inconvenient in that if the travel speed of the pressure roller is increased in order to increase productivity, a force applied to a driving transmission mechanism for the roller becomes excessive, and the mechanism becomes liable to be damaged. Further, the prior art apparatus is inconvenient in that if the travel speed of the pressure roller is increased the rolling speed of the pressure roller is also increased, thereby causing slippage between the pressure roller and the plate material as the travel direction of the pressure roller is reversed, which slippage results in a seizure phenomenon. Furthermore, the prior art apparatus is inconvenient in that is the pressing process using a single pressure roller, the plate material is pressed against the plate-form die at a single portion, so that the plate material is liable to be displaced in its width direction. Consequently, it is difficult to obtain a precise size of the product in the width direction of the plate of irregular sectional shape.

SUMMARY OF THE INVENTION

This invention has for its object to provide an apparatus which is free from the foregoing disadvantages and can perform a forming work of a plate of irregular cross-sectional shape with high precision and high efficiency.

This object is achieved in accordance with the invention by providing an improved pressure roller means which is arranged to cooperate with a conventional plate-form die having a plate surface portion sharpened at its leading edge portion. The pressure roller means in accordance with the invention comprises two pressure rollers which are arranged so that the respective axes of rotation of the pressure rollers are substantially parallel to each other and to the plane of the opposing surface of the strip of band of plate material being fed between the rollers and the die. The respective axes of rotation of the pressure rollers are separated by a predetermined distance in the direction of travel of the reciprocating rollers.

After the long strip or band of plate material provided on the plate surface portion of the plate-form die is pressed against the plate surface portion by the pressure roller means, and thereby the material is formed into a predetermined irregular cross-sectional shape according to the form of the die, the material is moved by the perdetermined length rearwards from the leading end portion of the die. By repeating the foregoing procedural steps, a long plate of irregular cross-sectional shape is formed having a small-thickness portion and a large thickness portion.

According to this invention, the pressure roller means includes two pressure rollers, for instance, which are arranged such that the respective axes of rotation are separated by a predetermined distance in the direction of travel of the reciprocating rollers, whereby the length of the reciprocating stroke of the pressure roller means for pressing the plate material is half of that of the conventional pressure roller means. Accordingly, the forming time can be shortened without increasing the travel or rolling speed of the pressure roller means. As a result, an excessive force is not applied to the driving transmission mechanism for the roller means, whereby damage to the driving transmission means can be prevented. Additionally, since the travel or rolling speed of the pressure rollers can be decreased, the magnitude of the inertia force for each roller can be decreased, so that no slippage occurs between the rollers and the plate material when the direction of travel of the roller is reversed. consequently, the seizure phenomenon which occurred in the prior art is eliminated by the invention.

Additionally, owing to the fact the plate material is pressed by two rollers at two portions against the plate-form die, any displacement of the plate material in its width direction is blocked. Accordingly, a plate of irregular cross-sectional shape can be formed with high precision of the width dimension thereof.

BRIEF DESCRIPTION OF THE DRAWINGS

The preferred embodiment of the invention will be described in detail hereinafter with reference to the accompanying drawings, wherein.

DETAILED DESCRIPTION OF THE PREFERRED EMBODIMENT

Figure 1:
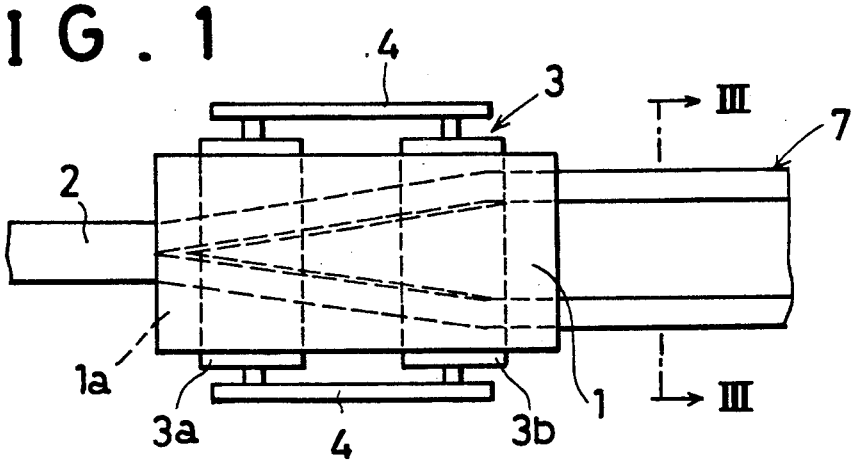
FIG. 1 is a top view of the preferred embodiment of the invention.
Figure 2:
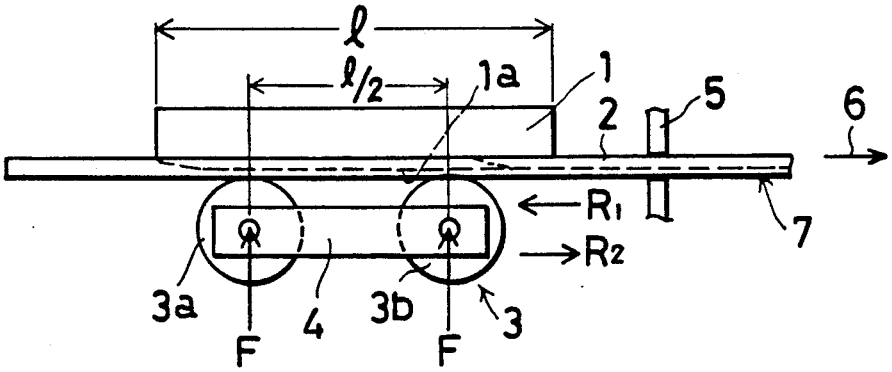
FIG. 2 is a side view of the preferred embodiment of the invention.

Referring to FIGS. 1 and 2, a stationary plate-form die 1 has a sharpened or wedge-shaped leading end portion. A long strip or band 2 of plate material such as stainless steel or the like is brought into contact with a plate surface portion 1*a* of the die 1. A pressure roller means 3 is arranged to reciprocate with a stroke corresponding to the plate surface portion 1*a* for pressing the long strip or band 2 plate material against the plate surface portion 1*a*.

According to this invention, the pressure roller means comprises a plurality of pressure rollers arranged such that their respective axes of rotation are separated by a predetermined distance in the direction of travel of the reciprocating rollers. In the illustrated example, the pressure roller means 3 includes two pressure rollers 3*a*, 3*b* which are rotatably mounted on a frame body 4 such that the axes of rotation of rollers 3*a*, 3*b* are parallel and separated by a distance l/2 in the direction of travel of the reciprocating rollers. A pressing force F can be applied to each roller by conventional means. The rollers roll in tandem first in one direction in response to the application of a force R1 and then in the opposite direction in response to the application of a force R2 (as shown in FIG. 2). The reciprocating forces R1 and R2 are applied by any conventional means. Such conventional means for applying pressure and reciprocating forces are disclosed in U.S. Pat. No. 3,792,602, the disclosure of which is incorporated herein by reference.

Figure 3:
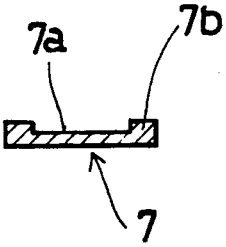
FIG. 3 is a cross-sectional view of the formed plate having a first cross-sectional shape taken along section III—III of FIG. 1.

In the preferred embodiment, the strip or band 2 of plate material is moved a predetermined distance in the direction of arrow 6 (See FIG. 2) by a clamp means 5 when the pressure roller means 3 is rolled to the left after one or more reciprocations of the pressures roller means 3. The clamp means may be the clamp-type traveling apparatus disclosed in U.S. Pat. No. 3,792,602. Each stroke of the roller means 3 has a length l corresponding to the length of the plate surface portion 1*a*. By repeating the reciprocating movements of the pressure roller means 3 and the advancement of the strip or band 2 of plate material, a long plate of irregular cross-sectional shape 7 having a small-thickness portion 7*a* and a large portion 7*b* (as shown in FIG. 3) is obtained.

Since the pressure roller means 3 in accordance with the preferred embodiment of the invention includes two rollers 3*a*, 3*b*, the length of the stroke of the pressure roller means 3 necessary for pressing the plate material 2 against the plate surface portion 1*a* of length l is l/2. Thus, the rolling pressing operation can be performed without increasing the rolling speed, in one half of the time required for the conventional case where the rolling pressing operation is performed by a single pressure roller.

Figure 4:
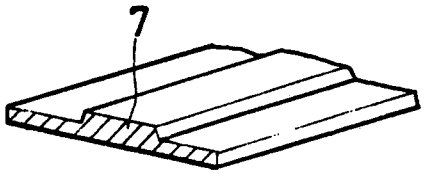
FIG. 4 is a perspective sectional view of a formed plate having a second cross-sectional shape.
Figure 5:
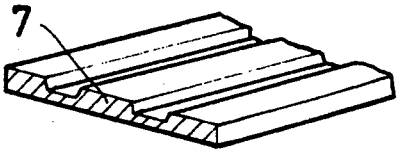
FIG. 5 is a perspective sectional view of a formed plate having a third cross-sectional shape.

The number of pressure rollers in accordance with the invention can be two as desired, and varied plates of irregular cross-sectional shape 7, as shown in FIG. 4 or FIG. 5, can be obtained by changing the shape of the plate-form die as desired.

Thus, in accordance with the invention, a pressure roller means arranged to be reciprocably moved for pressing a long strip or band of plate material against the plate surface portion of a plate-form die comprising two pressure rollers, so that the pressing time can be shortened without increasing the moving speed of the pressure roller means, whereby seizure of the rollers and the plate material can be prevented. In addition, because the plate material is pressed at a plurality of positions, the plate material can be prevented from displacment in its width direction, and a plate of irregular cross-sectional shape can be obtained which has high precision in its width dimension.

The foregoing description of the preferred embodiment is presented for illustrative purposes only and is not intended to limit the scope of the invention as defined in the appended claims. Modifications may be readily effected by one having ordinary skill in the art without departing from the spirt and scope of the inventive concept herein disclosed.

What is claimed is:

1. In an apparatus for forming a plate of irregular cross-sectional shape comprising a plateform die including a plate surface portion having a sharpened leading end portion, a pressure roller means, driving means for moving said pressure roller means reciprocably along a longitudinal axis for pressing a plate material against said plate surface portion of said die, and means for advancing said plate material a predetermined distance rearwardly from said leading end portion after each reciprocable movement of said pressure roller means, the improvement wherein said pressure roller means the comprises only first and second pressure rollers arranged for reciprocating movement, said first pressure roller having a first axis of rotation and said second pressure roller having a second axis of rotation, and wherein said first and second pressure rollers are respectively rotatably coupled to rigid support means by first and second pivot means whereby said first and second axes of rotation are substantially parallel to each other, are substantially perpendicular to said longitudinal axis, said axes of rotation being in a plane parallel to the plane of said plate surface portion of said die, and are separated by a predetermined distance substantially equal to one-half of the rolling distance of said pressure roller means in the course of one stroke, said rigid support means being driven to reciprocate by said driving means.

2. The improved apparatus as recited in claim 1, wherein said plate surface portion has a predetermined length and said first and second pressure rollers reciprocate with a stroke length which is equal to at least one half of said predetermined length.

3. An apparatus for forming a plate of irregular cross-sectional shape comprising a plateform die having a wedge-shaped forming means, said forming means comprising a planar surface portion having first and second leading edges which meet to form a tip of said wedge shape, a pressure roller means, driving means for moving said pressure roller means reciprocatively along a longitudinal axis parallel to said planar surface portion for pressing a plate material against said forming means of said die, and means for advancing said plate material a predetermined distance along said longitudinal axis rearwardly relative to said leading edges after each reciprocating movement of said pressure roller means, wherein said pressure roller means comprises only first and second pressure rollers arranged for reciprocating movement, said first pressure roller having a first axis of rotation and said second pressure roller having a second axis of rotation, and wherein said first and second pressure rollers are respectively rotatably coupled to rigid support means by first and second pivot means whereby said first and second axes of rotation are substantially parallel to each other, are substantially perpendicular to said longitudinal axis, said axes of rotation being in a plane parallel to the plane of said plate surface portion of said die, and are separated by a predetermined distance substantially equal to one-half of the rolling distance of said pressure roller means in the course of one stroke, said rigid support means being driven to reciprocate by said driving means.

* * * * *